United States Patent [19]

Folsom

[11] Patent Number: 4,852,725

[45] Date of Patent: Aug. 1, 1989

[54] CARRYING AND STORAGE CASE FOR ARTIST'S SUPPLIES

[76] Inventor: Dale Folsom, 42-49 Colden St., Flushing, N.Y. 11355

[21] Appl. No.: 232,941

[22] Filed: Aug. 17, 1988

[51] Int. Cl.[4] ..... B05C 17/00; B44D 3/00; B65D 1/24

[52] U.S. Cl. ..... 206/1.7; 206/575; 220/21; 220/22; 220/343

[58] Field of Search ..... 206/1.7, 1.8, 1.9, 81, 206/575; 220/21, 22, 343; 190/109, 900, 901

[56] References Cited

U.S. PATENT DOCUMENTS

| | | | |
|---|---|---|---|
| 3,225,913 | 12/1965 | Lee | 220/343 X |
| 3,352,616 | 11/1967 | Linger | 206/1.7 X |
| 4,061,224 | 12/1977 | Fuhri | 220/22 X |

FOREIGN PATENT DOCUMENTS

| | | | |
|---|---|---|---|
| 3003366 | 8/1981 | Fed. Rep. of Germany | 206/1.7 |
| 1157128 | 12/1957 | France | 206/1.7 |
| 6124 | of 1882 | United Kingdom | 206/1.8 |
| 1161277 | 8/1969 | United Kingdom | 206/1.7 |

*Primary Examiner*—William Price
*Attorney, Agent, or Firm*—Alan H. Levine

[57] ABSTRACT

A carrying and storage case for artist's supplies including a tray-like base and a plurality of rows of receptacles within the base, each row containing a plurality of receptacles. The axes of all the receptacles are at an acute angle to the plane of the back wall of the base, the angle opening toward the top wall of the base. A cover, hinged or otherwise moveable with respect to the base, is used to close the case. The case is ideally suited to carry drawing markers, each receptacle holding one marker, and preferably the case contains at least one hundred receptacles. The length of each receptacle is shorter than the length of the markers to be carried, so that one end of each of the markers extends beyond the receptacles and can be grasped for removal from the case. The receptacles may be defined by intersecting vertical and horizontally-extending partitions, the partitions interengaging by means of a series of slots formed at one edge of each partition. The hinge for pivotally interconnecting the base and cover is seperable by lifting one of the base or cover with respect to the other, so that the seperated cover can be used as a support surface on which the artist can work. The cover may be a tray-like member formed with a pocket or pockets for accommodating additional artist's supplies.

15 Claims, 3 Drawing Sheets

FIG. 1
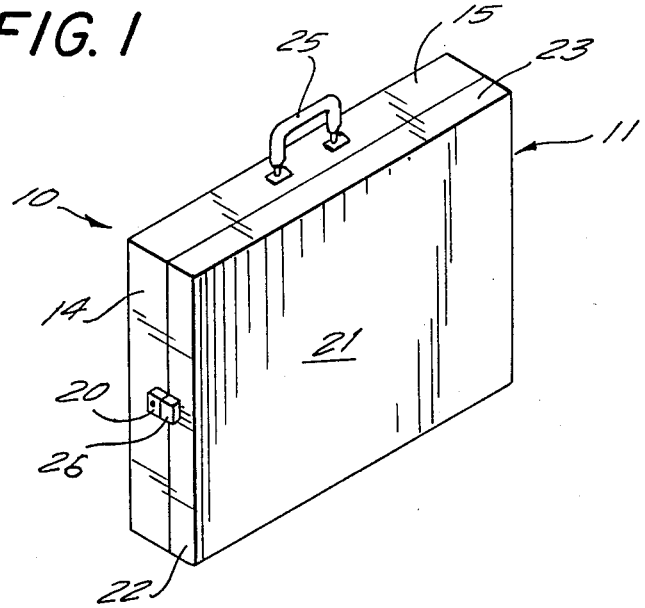
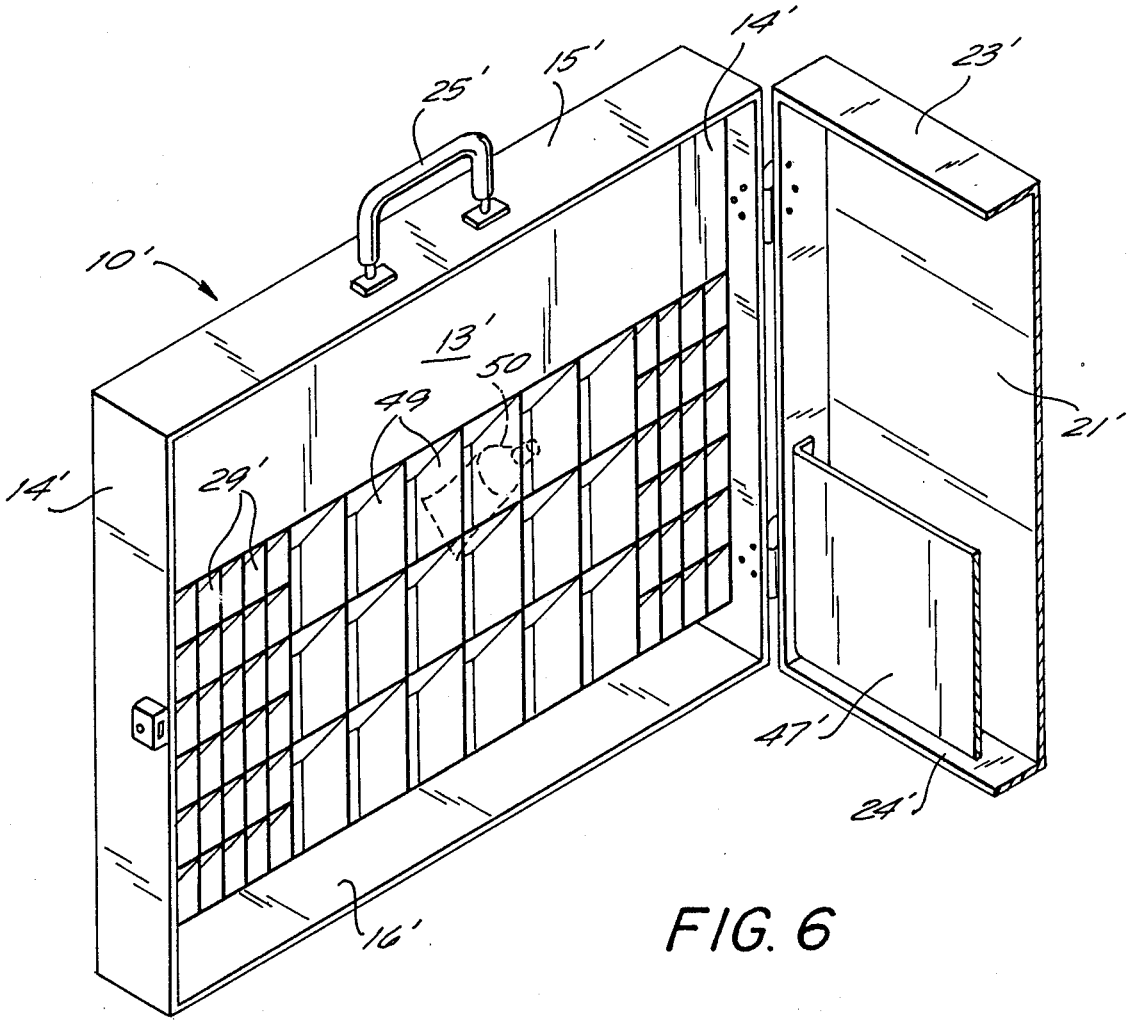
FIG. 6

CARRYING AND STORAGE CASE FOR ARTIST'S SUPPLIES

This invention relates to a carrying and storage case for artist's supplies, and more particularly to such a case in which supplies, such as drawing markers or paint tubes, are maintained in a preselected arrangement so that as soon as the case is opened, the artist is ready to work, without the need for setting or arranging the drawing instruments in a particular order.

Artist's are sometimes required to prepare drawings under time pressure and in less-than-ideal circumstances, i e., cramped working space. For example, commercial artists are often called upon by advertising agencies to quickly prepare renderings on the premises of the advertising agency where working space is at a premium. These renderings are prepared using colored drawing markers which are available in a large number of shades and tones of color. Thus, it is not unusual for an artist to carry well over one hundred drawing markers differing in color and shade.

Many artists carry these markers jumbled in a bag. When reaching the work site, such an artist needs time for "set-up", i.e., removing the markers from the bag and arranging them in a particular order, usually with shades of the same color arranged next to each other. During the work period, these markers invariably become rearranged and even misplaced. In addition, if more than one artist is working in the same cramped space, sorting out each artist's markers at the end of a work period can be quite time consuming.

It is an object of the present invention to provide an artist's carrying case in which a large number of markers, e.g., in excess of one hundred different colored markers, are stored in an orderly arrangement, each marker having it's own unique location. Once opened, the case serves as a supply point from which a desired marker can be readily obtained, and after the marker is used it can be returned to it's particular storage position so that it is always stored in the same orientation with respect to all the other markers in the case.

This objective is accomplished by forming the carrying and storage case of a tray-like base within which a large number of rows of receptacles are located, each receptacle accommodating a single marker, tube of paint, or the like.

According to the invention, all of the receptacles are arranged at an oblique angle to the back wall of the base. With this arrangement, almost as many receptacles can be provided within the case as could be provided if the receptacles were made perpendicular to the back wall of the base. However, since the receptacles, and hence the markers accommodated by them, are arranged at an oblique angle, the case can be made shallower than it would have to be if the markers were arranged perpendicular to the back wall of the base. In the latter circumstance, the depth of the case would be at least as large as the length of the longest marker, whereas use of the oblique angle arrangement permits the case to be shallower than the length of the markers.

Moreover, the angled arrangement of markers makes them easier to see and grasp quickly, as compared to markers arranged perpendicular to the back wall of the base.

It is another object of the invention to provide such a carrying and storage case having a cover hinged to the tray-like base, the hinge elements being separable so that the cover can be seperated from the base and used as a support surface on which an artist can work.

It is a further object of the invention to provide such a case wherein the cover is also a tray-like element which can be used for storing additional artist's materials.

Additional objects and features of the invention will be apparent from the following description, in which reference is made to the accompanying drawings.

In the drawings

FIG. 1 is a perspective view of the carrying and storage case for artist's supplies in closed condition;

FIG. 6 is a fragmentary perspective view of an alternative embodiment of the invention.

Figure 2:
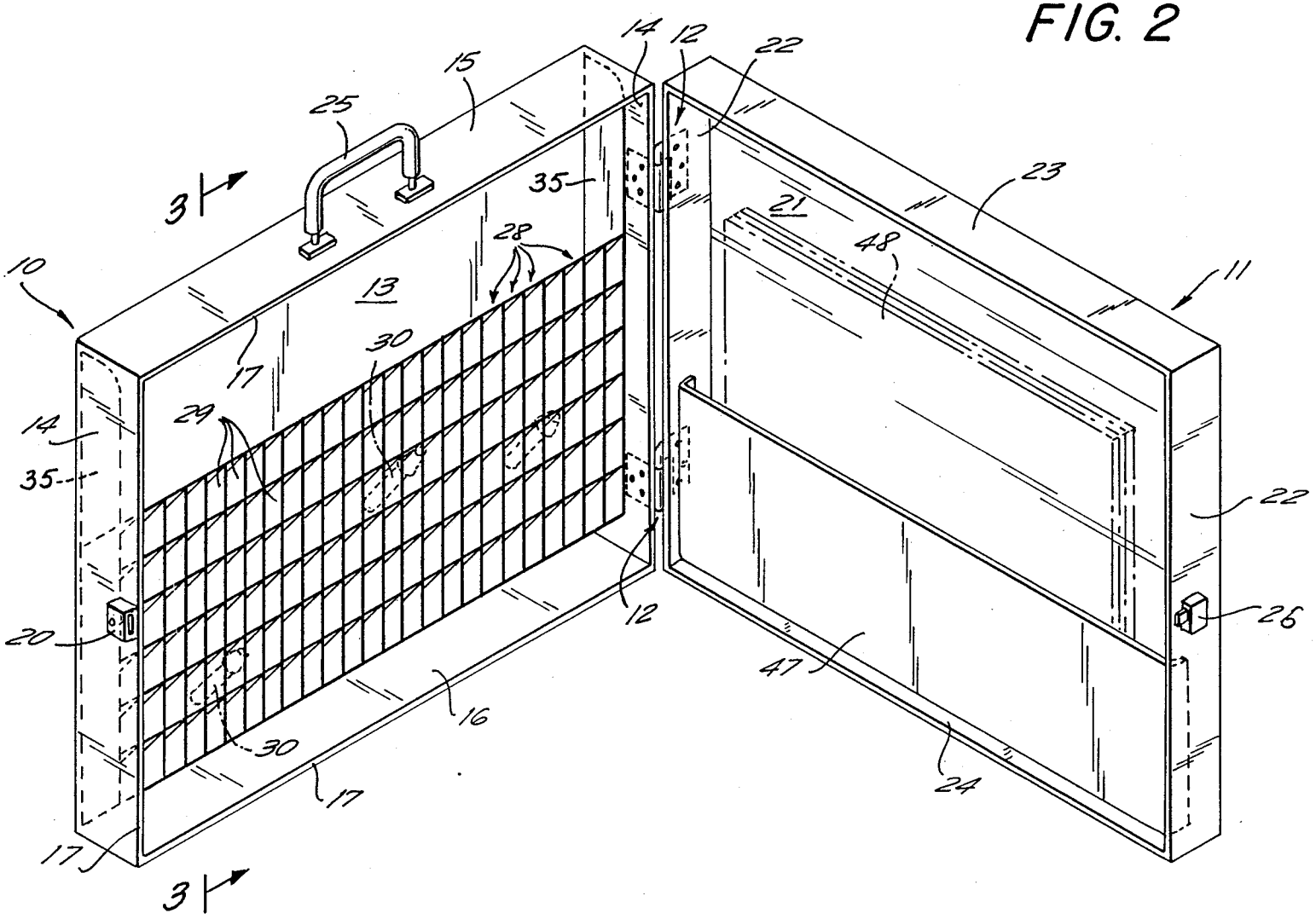
FIG. 2 is a perspective view of the case in open condition.

The carrying and storage case for artist's supplies chosen to illustrate the present invention resembles a somewhat large attache case, as shown in FIGS. 1 and 2. The case comprises a tray-like base 10 and a cover 11 pivotally joined together by hinges 12. Base 10 has a back wall 13, two side walls 14, a top wall 15, and a bottom wall 16. The free edges 17 of walls 14–16, opposite back wall 13, define an open front of base 10.

Cover 11 can be swung toward base 10, on hinges 12, to close the open front of base 10 and hence to close the case, as shown in FIG. 1. Suitable latching elements 20 and 26, mounted on base 10 and cover 11, respectively, serve to hold the base and cover in closed condition. Cover 11 can be swung away from base 10, as shown in FIG. 2, to open the case by exposing the open front of base 10.

Cover 11 could be a flat panel, but preferably is formed as a tray-like member somewhat shallower than base 10. Cover 11 has a back wall 21, two side walls 22, a top wall 23, and a bottom wall 24. A carrying handle 25 projects upwardly from the outer surface of top wall 15 of base 10.

Within base 10 are a plurality of vertical rows 28 of receptacles, each row containing a plurality of receptacles 29. In the present example, the base 10 contains twenty-four rows 28, each row containing six receptacles, for a total of one hundred forty-four receptacles. Each receptacle is sized to accomodate a single colored drawing marker 30 (see FIGS. 2 and 3). A case intended to hold drawing markers, as shown, should have at least one hundred individual receptacles 29 in order to be useful to a professional artist, who requires that many different shades and tones of colors to prepare commercial renderings.

Figure 5:
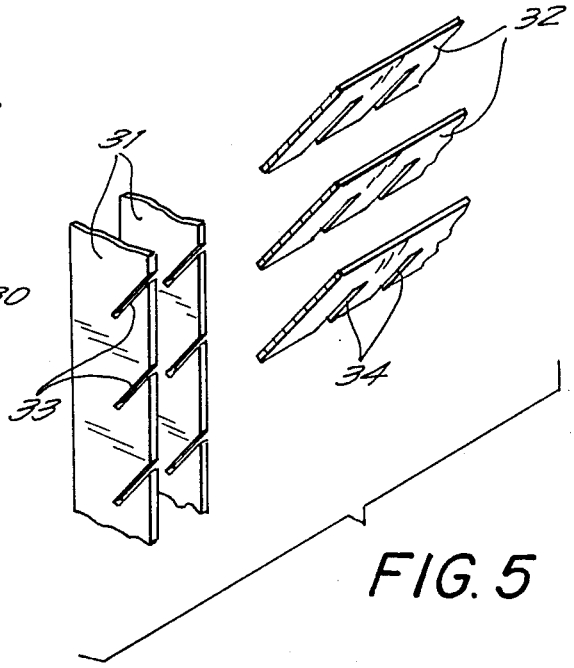
FIG. 5 is a fragmentary exploded perspective view showing the partitions which form the receptacles within the case.

Receptacles 29 may be formed by a plurality of horizontally spaced-apart vertical partitions 31 (FIG. 5) intersected by a plurality of vertically spaced-apart horizontally-extending partitions 32. In order to permit this intersecting relationship, each vertical partition 31 is formed with a plurality of angled slots 33 extending to the front edge of the partition. Similarly, each horizontally-extending partition 32 is formed with a plurality of slots 34 extending to the rear edge of the partition. By interengaging slots 33 and 34, a honey comb arrangement of receptacles 29 is created.

Figure 3:
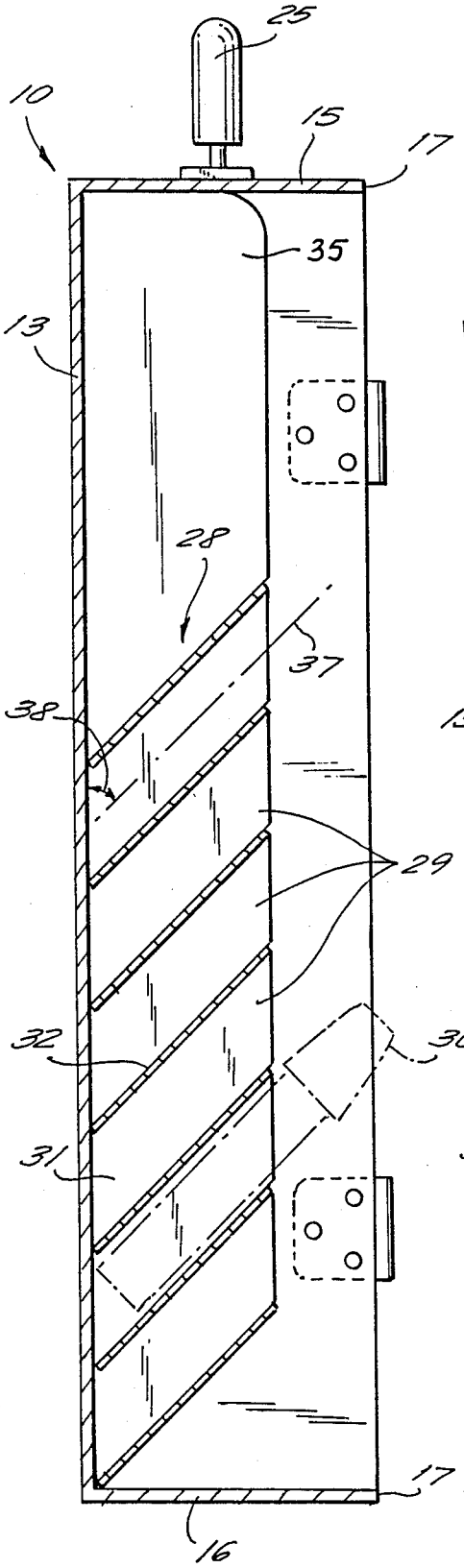
FIG. 3 is a vertical cross-sectional view taken along line 3—3 of FIG. 2.

The angled nature of slots 33 and vertical partitions 31 causes horizontally-extending partitions 32 to be oriented at an acute angle to the plane of back wall 13 of base 10. As a result, the longitudinal axis 37 (FIG. 3) of each receptacle is oriented at an acute angle 38 to back wall 13, the angle 38 opening toward the top wall 15 of base 10. The length of each receptacle 29, measured along axis 37, is shorter than the axial length of the markers to be accommodated within the receptacles, so that a portion of each marker projects forwardly beyond the front edge of its respective receptacle, as shown in FIG. 3. Therefore, in view of the length of most standard drawing markers, the axial length of each receptacle should be at most about five inches.

Arranging receptacles 29, and hence markers 30, at an acute angle to the plane of back wall 13 provides a number of advantages. An inspection of FIG. 3 will show that with this arrangement, the combined depth of base 10 and cover 11 can be smaller than would be possible if markers 30 were arranged perpendicular to back wall 13. In addition, when the open case is set on its bottom wall 16, as shown in FIG. 2, the angled nature of markers 30 makes them more easily visible to the artist and easier to grasp for removal from, and replacement in, the receptacles. Moreover, once an artist sets up his own arrangement of colored markers in receptacles 29, and becomes used to that arrangement, he will know immediately the location of each color which he desires to use, and hence use of the case will save a considerable amount of time in preparing drawings.

Figure 4:
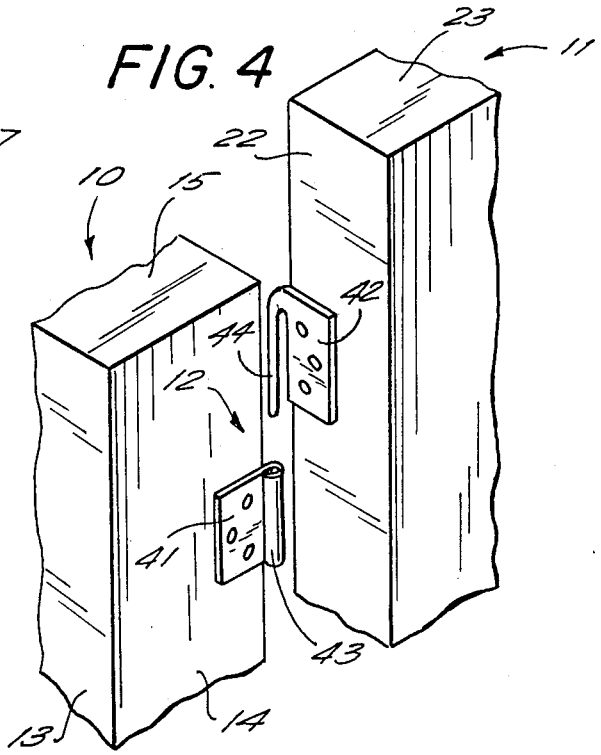
FIG. 4 is a fragmentary perspective view showing the hinge elements in seperated condition.

Advantageously, hinges 12 are made as shown in FIG. 4. Each hinge includes the hinge element 41 secured to one of the side walls 14 of base 10, and a hinge element 42 secured to one of the side walls 22 of cover 11. Hinge element 41 includes a tubular bearing part 43, and hinge element 42 carries a pin 44 attached to the remainder of hinge element 42 at its upper end, but otherwise free of attachment to the remainder of the hinge element. Pin 44 is adapted to be rotatably accommodated within bearing part 43. When the parts are assembled, as shown in FIG. 2, pin 44 rotates within bearing part 43 to pivotally interconnect base 10 and cover 11. When desired, cover 11 can be raised vertically with respect to base 10 so as to slide pins 44 out of bearing parts 43, thereby seperating cover 11 from base 10. After this seperation, the artist can rest cover 11 in his or her lap, or on a non-planar surface, and use back wall 21 of cover 11 as a support surface on which to work.

Advantageously, a rigid or flexible band 47 (FIG. 2), having a height less than that of cover 11, can extend between the side walls 22 of cover 11 so as to create a pocket between band 47 and back wall 21 of the cover. The ends of the band can be secured to side walls 22 in any suitable manner. This pocket can be used to hold additional artist's supplies, such as a drawing pad 48. Of course, more than one pocket can be created within cover 11, so as to hold additional supplies, such as paint brushes.

The illustrative case described above is intended to hold drawing markers. However, by altering the size of some or all of the receptacles 29, other types of artist's supplies can be accommodated by the case. Thus, an alternative embodiment of the invention is illustrated by FIG. 6, in which parts similar to those described above with respect to FIGS. 1–5 bear the same reference numerals as in the earlier figures, followed by a prime. In this embodiment, base 10' holds a smaller number of marker receptacles 29' than are accommodated by base 10. However, larger size receptacles 49 are provided for holding tubes of paint 50. As with the receptacles 29 of FIG. 1–5, the receptacles 29' and 49 of the embodiment of FIG. 6 are arranged at an acute angle to the plane of back wall 13'.

Partitions 31 and 32 may be held together by friction resulting from a tight fit of each partition in the slots of the partitions which cross it. Alternatively, a suitable adhesive may be employed to hold the honey comb arrangement of partitions together. Desirably, the entire receptacle arrangement formed by intersecting partitions 31 and 32 is adhesively secured within base 10. To aid in this securement, the receptacle arrangement can be provided with side panels 35 which are secured to the inner surfaces of side walls 14 by an adhesive.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A carrying and storage case for artist's supplies comprising:

a tray-like base having a back wall, two side walls, a top wall, a bottom wall, and an open front, a plurality of rows of receptacles within the base, each row containing a plurality of receptacles, the axes of all the receptacles being at an acute angle to the plane of the back wall of the base, said angle opening toward the top wall of the base, and a cover movable with respect to the base for optionally closing the open front thereof.

2. A carrying and storage case as defined in claim 1 wherein there are a minimum of one hundred receptacles within the base.

3. A carrying and storage case as defined in claim 1 wherein all the receptacles are the same size.

4. A carrying and storage case as defined in claim 1 wherein some of the receptacles are larger in cross-sectional dimension than others of the receptacles.

5. A carrying and storage case as defined in claim 1 in combination with a plurality of drawing markers, each receptacle being adapted to accommodate one of the drawing markers, and the axial length of each receptacle being shorter than the length of a marker, so that when a marker is within a receptacle one end of the marker projects out of the receptacle and can be grasped to remove the marker from the receptacle.

6. A carrying and storage case as defined in claim 1 wherein the axial length of each receptacle is at most five inches.

7. A carrying and storage case as defined in claim 1 wherein the receptacles of each row are in vertical alignment, and each receptacle is horizontally aligned with one of the receptacles in every other row.

8. A carrying and storage case as defined in claim 1 including a plurality of horizontally spaced-apart vertical partitions within the base, and a plurality of vertically spaced-apart horizontally-extending partitions intersecting the vertical partitions, the intersecting vertical and horizontally-extending partitions defining the receptacles.

9. A carrying and storage case as defined in claim 8 wherein the plane containing each horizontally-extending partition is at an acute angle to the plane of the back wall of the base.

10. A carrying and storage case as defined in claim 8 including a plurality of slots in each partition, all the slots extending to one of the longitudinal edges of the partition, and the slots of the vertical partitions being engaged with the slots of the horizontally-extending partitions.

11. A carrying and storage case as defined in claim 1 including a carrying handle mounted on the top wall of the base adapted to be grasped when carrying the case.

12. A carrying and storage case as defined in claim 1 including hinge means for pivotally joining the base and cover, the hinge means including a first part secured to one of the base and cover and a second part secured to the other of the base and cover, the first part having a pin and the second part having a tubular bearing rotatably accommodating the pin, one end of the pin being free of attachment to the remainder of said first part, so that the pin can be moved axially out of the bearing to seperate the two parts of the hinge means and hence seperate the base and cover.

13. A carrying and storage case as defined in claim 12 wherein the cover includes a flat panel which can serve as a support surface on which an artist can work when the cover is seperated from the base.

14. A carrying and storage case as defined in claim 1 wherein the cover is a tray-like member having a back wall, two side walls, a top wall, a bottom wall, and an open front, and hinge means pivotally joining the base and cover so that they can be swung toward each other to close the base and away from each other to open the base.

15. A carrying and storage case as defined in claim 14 including a member extending across a portion of the open front of the cover to define a pocket in the cover for accommodating artist's supplies.

* * * * *